US008184061B2

(12) United States Patent
Sanford

(10) Patent No.: US 8,184,061 B2
(45) Date of Patent: May 22, 2012

(54) ANTENNA SYSTEM AND METHOD

(75) Inventor: John R. Sanford, Encinitas, CA (US)

(73) Assignee: Ubiquiti Networks, San Jose, CA (US)

( * ) Notice: Subject to any disclaimer, the term of this patent is extended or adjusted under 35 U.S.C. 154(b) by 428 days.

(21) Appl. No.: 12/560,424

(22) Filed: Sep. 16, 2009

(65) Prior Publication Data

US 2011/0063182 A1 Mar. 17, 2011

(51) Int. Cl.
*H01Q 13/00* (2006.01)

(52) U.S. Cl. ..... 343/773; 343/786

(58) Field of Classification Search ..... 343/771, 343/772, 786, 848, 773
See application file for complete search history.

(56) References Cited

U.S. PATENT DOCUMENTS

| | | | | |
|---|---|---|---|---|
| 4,658,262 | A | 4/1987 | DuHamel | |
| 4,757,324 | A * | 7/1988 | Dhanjal | 343/776 |
| 4,758,842 | A * | 7/1988 | Linhardt et al. | 343/786 |
| 6,208,310 | B1 * | 3/2001 | Suleiman et al. | 343/786 |
| 6,252,559 | B1 | 6/2001 | Donn | |
| 6,593,892 | B2 | 7/2003 | Honda et al. | |
| 6,844,862 | B1 | 1/2005 | Cencich et al. | |
| 2002/0187760 | A1 * | 12/2002 | Krishmar-Junker et al. | 455/125 |
| 2004/0233107 | A1 | 11/2004 | Popov et al. | |
| 2008/0048927 | A1 * | 2/2008 | Hoshi | 343/850 |
| 2009/0237314 | A1 * | 9/2009 | Lalezari | 343/721 |

OTHER PUBLICATIONS

Kishk, A. A. et al, "Conical dielectric resonator antennas for wide-band applications",IEEE Trans., vol. AP-50 Issue 4, Apr. 2002, pp. 469-474.

* cited by examiner

*Primary Examiner* — Tan Ho
(74) *Attorney, Agent, or Firm* — Antero & Tormey LLP; Pete Tormey

(57) ABSTRACT

A device comprising a metallic conical portion, said conical portion substantially hollow having a vertex end and a base end, a first cylindrical portion disposed annularly about the base end of the conical portion, a metallic second cylindrical portion coupled to the vertex of the conical portion, said cylindrical portion having a threaded aperture, and an antenna feed coupled to the threaded aperture. The device may have a patch disposed on an insulator portion connected to the second cylindrical portion, said patch and insulator portion each having an aperture, and a metallic ground portion connected to the insulator portion, said ground portion having an ground aperture, and a threaded screw disposed through the ground aperture, the patch, the insulator aperture and into the threaded aperture. An RF feed may be created by coupling the threaded aperture to a conductive material disposed on the insulator portion.

12 Claims, 3 Drawing Sheets

ANTENNA SYSTEM AND METHOD

BACKGROUND

The present invention relates generally to antenna systems and more particularly to a low profile, easy to manufacture antenna system for use in wireless data and voice systems operating above 1 GHz.

Wireless fidelity, referred to as "WiFi" generally describes a wireless communications technique or network that adheres to the specifications developed by the Institute of Electrical and Electronic Engineers (IEEE) for wireless local area networks (LAN). A WiFi device is considered operable with other certified devices using the 802.11 specification of the IEEE. These devices allow wireless communications interfaces between computers and peripheral devices to create a wireless network for facilitating data transfer. This often also includes a connection to a local area network (LAN).

Operating frequencies range within the WiFi family, and typically operate around the 2.4 GHz band and 5 GHz band of the spectrum. Multiple protocols exist at these frequencies and these may also differ by transmit bandwidth.

Because the small transmission (TX) power from the transmitters of access points (APs), laptops and similar wireless devices are generally the weakest link in a WiFi system, it is of key importance to utilize high gain antenna systems. Antenna gain provides for directional capabilities of the radiation pattern, which is important in some applications such as extended distances and high WiFi density areas.

High gain, low cost and easy manufacturability have traditionally been obstacles for antennas designers because portable systems require a more rugged design which tends towards increased costs.

SUMMARY

Disclosed herein is a device comprising a hollow metallic conical portion, having a vertex end and a base end. A first cylindrical portion disposed annularly about the base end of the conical portion and a second metallic cylindrical portion coupled to the vertex of the conical portion. The cylindrical portion on the vertex end may have an aperture for receiving an antenna feed from a radio transmitter. The aperture may be threaded.

The device may also have a patch portion connected to the second cylindrical portion. The patch portion may have an aperture through it. The patch is disposed on an insulator such as a printed circuit board, and a metallic ground portion may also be connected to an insulator opposite the patch. The ground portion may have an aperture through it for receiving a fastener. The screw may be used to connect together the ground, the patch, the insulator and the cone. The screw or other fastener may also hold in place a radio frequency (RF) feed to the threaded aperture on the conical portion. Additionally an RF feed may be adhered to the patch and a portion of the cylinder on the vertex end disposed in electrical contact with the RF feed.

The device may be arranged in an array to provide for an effective radiation pattern and the elements or the array and height of the radiators positions to provide for impedance matching and improved antenna gain.

The construction and method of operation of the invention, however, together with additional objectives and advantages thereof will be best understood from the following description of specific embodiments when read in connection with the accompanying drawings.

DESCRIPTION

Figure 1:
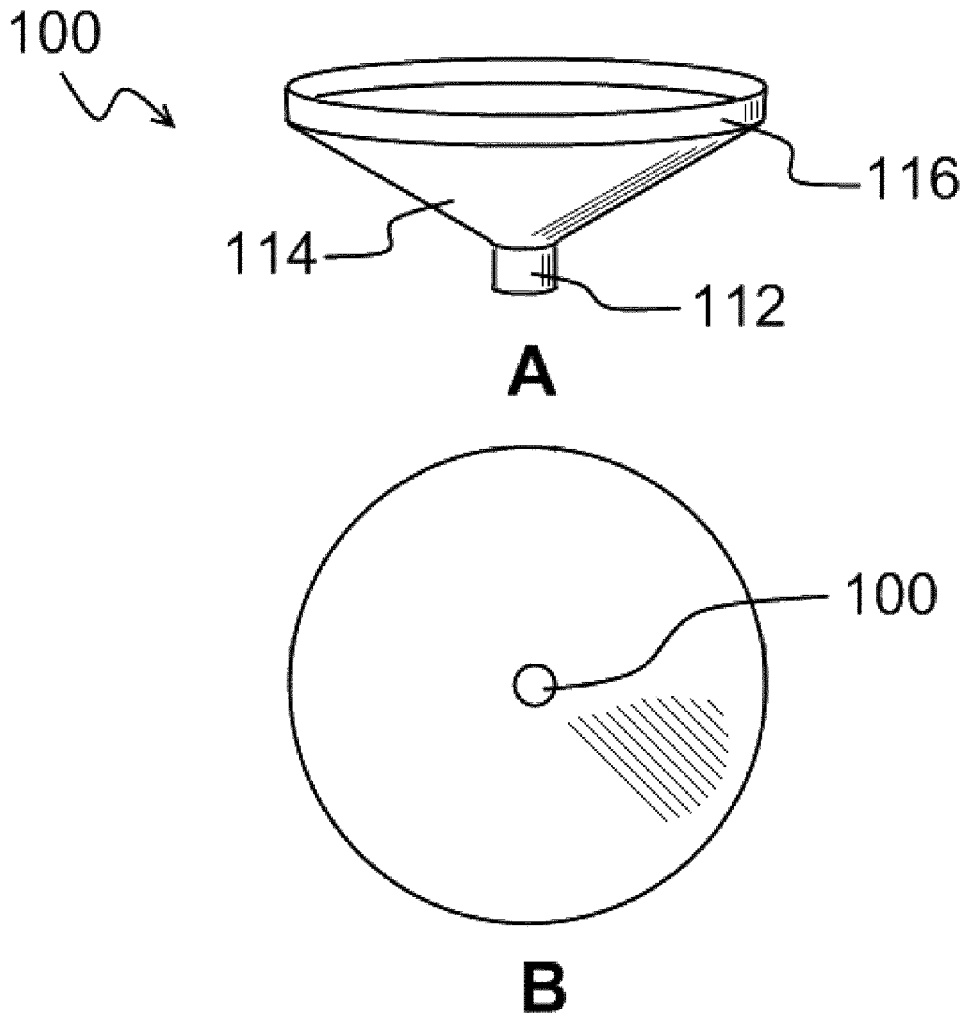
FIG. 1 illustrates a conical shape the radiator.

Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Generality of the Description

Read this application in its most general possible form. For example and without limitation, this includes:

References to specific techniques include alternative, further, and more general techniques, especially when describing aspects of this application, or how inventions that might be claimable subject matter might be made or used.

References to contemplated causes or effects, e.g., for some described techniques, do not preclude alternative, further, or more general causes or effects that might occur in alternative, further, or more general described techniques.

References to one or more reasons for using particular techniques, or for avoiding particular techniques, do not preclude other reasons or techniques, even if completely contrary, where circumstances might indicate that the stated reasons or techniques might not be as applicable as the described circumstance.

Moreover, the invention is not in any way limited to the specifics of any particular example devices or methods, whether described herein in general or as examples. Many other and further variations are possible which remain within the content, scope, or spirit of the inventions described herein. After reading this application, such variations would be clear to those of ordinary skill in the art, without any need for undue experimentation or new invention.

Lexicography

Read this application with the following terms and phrases in their most general form. The general meaning of each of these terms or phrases is illustrative but not limiting.

The terms "antenna", "antenna system" and the like, generally refer to any device that is a transducer designed to transmit or receive electromagnetic radiation. In other words, antennas convert electromagnetic radiation into electrical currents and vice versa. Often an antenna is an arrangement of conductor(s) that generate a radiating electromagnetic field in response to an applied alternating voltage and the associated alternating electric current, or can be placed in an electromagnetic field so that the field will induce an alternating current in the antenna and a voltage between its terminals.

The phrase "wireless communication system" generally refers to a coupling of EMF's (electromagnetic fields) between a sender and a receiver. For example and without limitation, many wireless communication systems operate with senders and receivers using modulation onto carrier frequencies of between about 2.4 GHz and about 5 GHz. However, in the context of the invention, there is no particular reason why there should be any such limitation. For example and without limitation, wireless communication systems might operate, at least in part, with vastly distinct EMF frequencies, e.g., ELF (extremely low frequencies) or using light (e.g., lasers), as is sometimes used for communication with satellites or spacecraft.

The phrase "access point", the term "AP", and the like, generally refer to any devices capable of operation within a wireless communication system, in which at least some of their communication is potentially with wireless stations. For example, an "AP" might refer to a device capable of wireless communication with wireless stations, capable of wire-line or wireless communication with other AP's, and capable of wire-line or wireless communication with a control unit. Additionally, some examples AP's might communicate with devices external to the wireless communication system (e.g., an extranet, internet, or intranet), using an L2/L3 network. However, in the context of the invention, there is no particular reason why there should be any such limitation. For example one or more AP's might communicate wirelessly, while zero or more AP's might optionally communicate using a wire-line communication link.

The term "filter", and the like, generally refers to signal manipulation techniques, whether analog, digital, or otherwise, in which signals modulated onto distinct carrier frequencies can be separated, with the effect that those signals can be individually processed.

By way of example, in systems in which frequencies both in the approximately 2.4 GHz range and the approximately 5 GHz range are concurrently used, it might occur that a single band-pass, high-pass, or low-pass filter for the approximately 2.4 GHz range is sufficient to distinguish the approximately 2.4 GHz range from the approximately 5 GHz range, but that such a single band-pass, high-pass, or low-pass filter has drawbacks in distinguishing each particular channel within the approximately 2.4 GHz range or has drawbacks in distinguishing each particular channel within the approximately 5 GHz range. In such cases, a $1^{st}$ set of signal filters might be used to distinguish those channels collectively within the approximately 2.4 GHz range from those channels collectively within the approximately 5 GHz range. A $2^{nd}$ set of signal filters might be used to separately distinguish individual channels within the approximately 2.4 GHz range, while a $3^{rd}$ set of signal filters might be used to separately distinguish individual channels within the approximately 5 GHz range.

The phrase "isolation technique", the term "isolate", and the like, generally refer to any device or technique involving reducing the amount of noise perceived on a $1^{st}$ channel when signals are concurrently communicated on a $2^{nd}$ channel. This is sometimes referred to herein as "crosstalk", "interference", or "noise".

The phrase "null region", the term "null", and the like, generally refer to regions in which an operating antenna (or antenna part) has relatively little EMF effect on those particular regions. This has the effect that EMF radiation emitted or received within those regions are often relatively unaffected by EMF radiation emitted or received within other regions of the operating antenna (or antenna part).

The term "radio", and the like, generally refer to (1) devices capable of wireless communication while concurrently using multiple antennae, frequencies, or some other combination or conjunction of techniques, or (2) techniques involving wireless communication while concurrently using multiple antennae, frequencies, or some other combination or conjunction of techniques.

The terms "polarization", "orthogonal", and the like, generally refer to signals having a selected polarization, e.g., horizontal polarization, vertical polarization, right circular polarization, left circular polarization. The term "orthogonal" generally refers to relative lack of interaction between a $1^{st}$ signal and a $2^{nd}$ signal, in cases in which that $1^{st}$ signal and $2^{nd}$ signal are polarized. For example and without limitation, a $1^{st}$ EMF signal having horizontal polarization should have relatively little interaction with a $2^{nd}$ EMF signal having vertical polarization.

The phrase "wireless station" (WS), "mobile station" (MS), and the like, generally refer to devices capable of operation within a wireless communication system, in which at least some of their communication potentially uses wireless techniques.

The phrase "patch antenna" or "microstrip antenna" generally refers to an antenna formed by suspending a single metal patch over a ground plane. The assembly may be contained inside a plastic radome, which protects the antenna structure from damage. A patch antenna is often constructed on a dielectric substrate to provide for electrical isolation.

The phrase "dual polarized" generally refers to antennas or systems formed to radiate electromagnetic radiation polarized in two modes. Generally the two modes are horizontal radiation and vertical radiation.

The phrase "patch" generally refers to a metal patch suspended over a ground plane. Patches are used in the construction of patch antennas and often are operable to provide for radiation or impedance matching of antennas.

DETAILED DESCRIPTION

FIG. 1 illustrates a conical shape the radiator 100. The FIG. 1A illustrates a perspective view and the FIG. 1B illustrates a 2-dimensional bottom view. The radiator may be formed from an electrically conductive material of the type conventionally found in antenna radiators such as aluminum, copper and other malleable metals. The radiator 100 may be stamped from a single piece of electrically conductive material.

The radiator 100 includes a substantially conical portion 114 having two cylindrical portions. The conical portion 114 is formed of a lateral surface having a predetermined thickness. Thus, by way of example, the conical portion 114 could be a hollow cone. A top cylindrical portion 116 is disposed along the base of the conical portion 114. The top cylindrical portion 116 is a lateral surface having a predetermined thickness and is electrically coupled to the conical portion 114. The top cylindrical portion 166 is disposed annularly about the base of the conical portion 114. A bottom cylindrical portion 112 is disposed about the vertex of the conical portion 114. For purposes of the current disclosure, the vertex of the conical portion 114 need not form a point, but may be flattened or rounded to allow for disposing the bottom cylindrical portion 112. The bottom cylindrical portion 112 may be substantially solid, or may be substantially hollowed and formed as a lateral surface.

The bottom center of the radiator 100 contains an aperture 110 having an unbroken circumference. The aperture 110 may be a smooth through-hole through the bottom cylindrical portion 112 or a threaded through hole through the bottom cylindrical portion 112. The aperture 110 need not extend completely through the bottom cylindrical portion 112.

In operation the aperture 110 would be electrically coupled to a final amplifier of a radio transmitter (not shown) such that the aperture 110 would function as an antenna feed point or feed area. The radiator element could be impedance matched to the amplifier either by constructing the radiator element to predetermined dimensions or through an additional circuit (not shown) tuned to the impedance of the transmission system. The inventor has found that disposing the radiator above a patch (not shown) and adjusting the height of the cylindrical portion 112 may provide optimal ways for impedance matching. When the radio transmitter is transmitting, the radiator 100 would be electrically excited at the frequency of transmission and radiate energy away from the radiator 100. The height of the cylindrical portion 112 may be altered to effectuate tuning of a transmission system.

References in the specification to "one embodiment", "an embodiment", "an example embodiment", etc., indicate that the embodiment described may include a particular feature, structure or characteristic, but every embodiment may not necessarily include the particular feature, structure or characteristic. Moreover, such phrases are not necessarily referring to the same embodiment. Further, when a particular feature, structure or characteristic is described in connection with an embodiment, it is submitted that it is within the knowledge of one of ordinary skill in the art to effectuate such feature, structure or characteristic in connection with other embodiments whether or not explicitly described. Parts of the description are presented using terminology commonly employed by those of ordinary skill in the art to convey the substance of their work to others of ordinary skill in the art.

Figure 2:
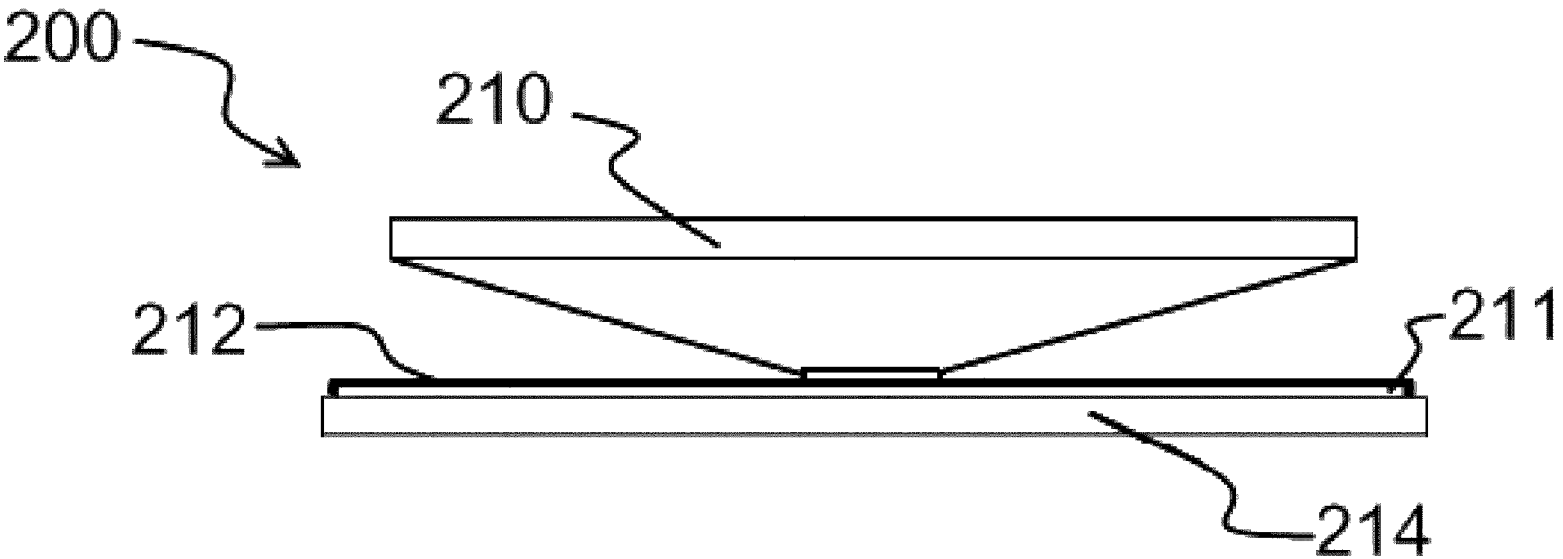
FIG. 2 depicts a radiator assembly according to one aspect of the current disclosure.

FIG. 2 depicts a radiator assembly 200 according to one aspect of the current disclosure. The radiator assembly 200 includes a radiator 210 connected to a dielectric material 211 and a metallic patch 212 disposed on the top surface of the dielectric material 211. The dielectric material is connected to a ground surface 214 which provides for a zero electrical potential area. The dielectric material can be any material suitable for isolating an electric current. Some examples of dielectrics include porcelain, glass, and most plastics. In some embodiments, the dielectric material could be a portion of conventional printed circuit board material of the type commonly used in the microwave communications industry. The patch may be any electrically conductive material such as copper or aluminum. The radiator assembly 200 is functionally a radiator 210 suspended above a patch and a ground surface 214.

In operation the radiator assembly 200 provides for an antenna feed to connect to the radiator 210 at a point on the bottom conical portion 216 of the radiator 210. The antenna feed may be coupled to the radiator 210 at an aperture (not shown) disposed in a bottom cylindrical portion 216 of radiator 210. To provide for the antenna feed to the radiator 210 an aperture may be formed in both the dielectric and the patch 212 and the ground surface 214. The antenna feed allows for coupling the radiator to a transmitter. The antenna feed may be coupled to the radiator using fasteners having the affect that, if the radiator has a threaded aperture in the radiator 210, the antenna feed may be coupled using a threaded screw. Fastening the radiator 210 to the antenna feed may also provide for physical stability by connecting the radiator securely to the dielectric material.

In some embodiments, the antenna feed may be disposed on the dielectric material and electrical coupling from the transmitter to the patch 212 and the radiator 210 may be effectuated by physically connecting the radiator at the bottom cylindrical portion 216 to the patch 212 on the surface of the dielectric. Non-conductive fasteners may also be used to physically hold the radiator in position if necessary.

Figure 3:
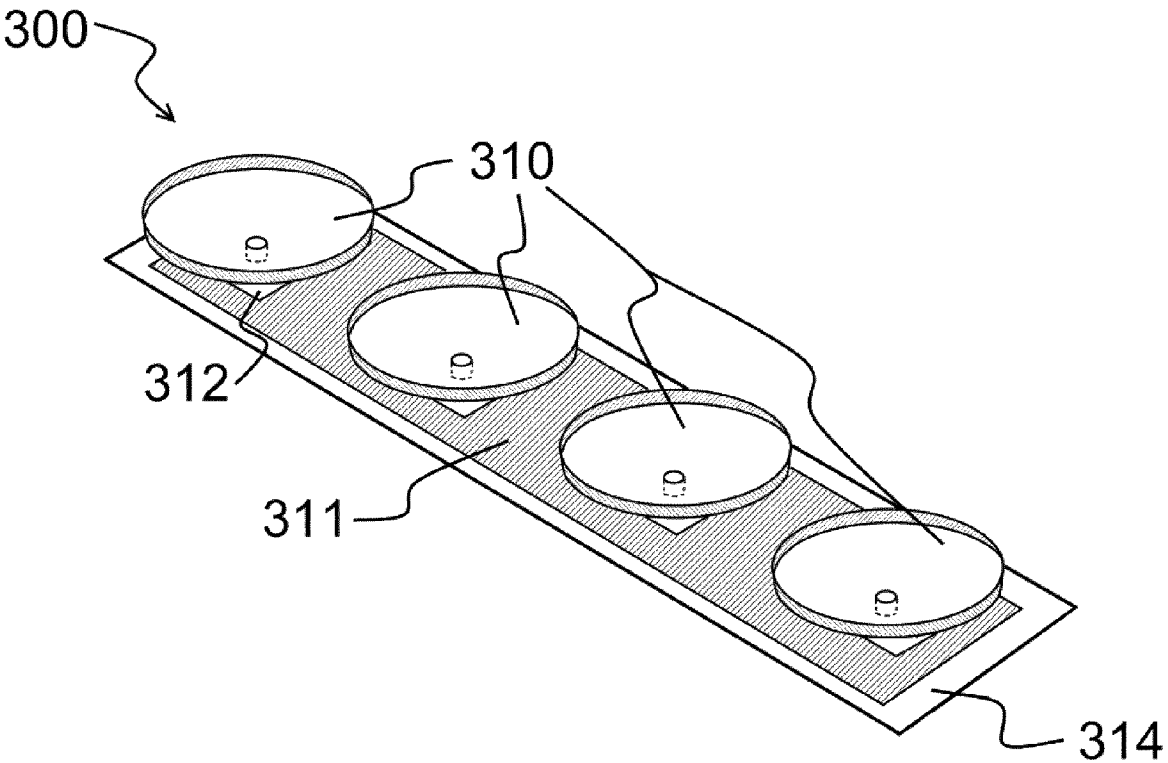
FIG. 3 shows an antenna array comprising multiple radiators.

FIG. 3 shows an antenna array 300 comprising multiple radiators. In the FIG. 3 multiple radiators 310 are electronically coupled to a single radio transmitter (not shown). Each radiator 310 is mounted on a dielectric surface 311 having a patch 312. The patch is formed from electrically conductive material and may be formed from the same material as the radiator 310. The dielectric surfaces are disposed on a ground plane 314. Disposing the radiators 312 in an array 300 above a patch 312 provides for control of the radiation pattern produced by the antenna array. Placement of radiators 310 may reinforce the radiation pattern in a desired direction and suppressed in undesired directions.

One having skill in the art will recognized that the antenna radiators 310 can be arranged to form a 1 or 2 dimensional antenna array. Each radiator 310 exhibits a specific radiation pattern. The overall radiation pattern changes when several antenna radiators are combined in an array. The array directivity increases with the number of radiators and with the spacing of the radiators. The size and spacing of antenna array determines the resulting radiation pattern. The radiators may be sized for proper impedance matching for a communications system, and the spacing between radiators creates the shape of the resulting radiation pattern. The resulting radiation pattern of the antenna array may be effectuated for operation in the 2.4 GHz or 5 GHz communications bands if the center-to-center spacing is approximately 0.7λ (70% of the wavelength of operation). Likewise the diameter of the radiators would be approximately 0.4λ of the wavelength of operation. Similarly the patch would be sized to be approximately 0.4λ, roughly the size of the conical radiator 310 at its broadest point.

The antenna array 300 may also provide for an antenna feed to the radiators 310. This may be effectuated by an antenna feed coupled to a portion of the patch 312. RF energy applied to the patch 312 would be electrically coupled to the radiator 310. The radiator may be secured to the dielectric material 311 by a screw which would be inserted though an aperture in the patch 312 and the dielectric material 311 and into a portion of the radiator 310. The radiator may be threaded for receiving a screw or alternatively a nut could be used to secure the screw. In addition, the ground surface 314 may have an aperture for passing a fastener, thus allowing the ground surface 314, dielectric material 311 and patch 312 to provide structural support for the radiator 410. Fasteners may be screws, nuts with bolts, or other fasteners conventionally used on the electronic industry provided the fasteners have sufficient strength and electrical properties.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A device comprising:

a metallic conical portion, said conical portion substantially hollow having a vertex end and a base end;

a first cylindrical portion disposed annularly about the base end of the conical portion;

a metallic second cylindrical portion coupled to the vertex of the conical portion;

an antenna feed coupled to the second cylindrical portion;

a patch connected to the second cylindrical portion, said patch disposed on an insulator portion, said patch and insulator portion each having apertures;

a metallic ground portion connected to the insulator portion, said ground portion having an ground aperture, and a threaded screw disposed through the ground aperture, the insulator aperture and the patch aperture and into the second cylindrical portion.

2. The device of claim 1 further wherein the antenna feed is coupled to the second cylindrical portion through the patch.

3. The device of claim 1 wherein the diameter of the base end is approximately either 5 centimeters or 2.4 centimeters.

4. The device of claim 1 wherein the second cylindrical portion has an aperture for receiving a fastener.

5. The device of claim 4 wherein the aperture is threaded and the fastener is a screw.

6. The device of claim 4 wherein the aperture is not threaded and the fastener is a screw and a nut assembly.

7. A device comprising:

a metallic ground portion, said ground portion having a plurality of ground apertures;

at least one insulator portion disposed on the ground portion;

a plurality of patches disposed on the insulator portion;

a conical radiator connected to each patch, and a feed connector electrically coupled to each conical radiator.

8. The device of claim 7 wherein the feed connector is a metal adhered to each insulator portion.

9. The device of claim 7 wherein the radiators are spaced apart a distance of approximately either 8.75 centimeters or 4.2 centimeters.

10. The device of claim 7 wherein the diameter of the base of the conical radiator is approximately either 5 centimeters or 2.4 centimeters.

11. A radio electrically coupled to the device of claim 7.

12. An access point electronically coupled to the device of claim 7.

* * * * *